US006530553B1

(12) United States Patent
Diorio et al.

(10) Patent No.: US 6,530,553 B1
(45) Date of Patent: Mar. 11, 2003

(54) METHOD AND APPARATUS FOR MAKING CONCRETE BUILDINGS

(76) Inventors: Philip A. Diorio, 4231 Willow Park Dr., Orlando, FL (US) 32835; Enrique Rodriguez Negrón, Urb Sabanera 386 Camino de Los Jardine, Cidra, PR (US) 00739-9766

( * ) Notice: Subject to any disclaimer, the term of this patent is extended or adjusted under 35 U.S.C. 154(b) by 0 days.

(21) Appl. No.: 09/840,463

(22) Filed: Apr. 23, 2001

Related U.S. Application Data

(63) Continuation of application No. 09/354,433, filed on Sep. 20, 1999, now abandoned.

(51) Int. Cl.[7] ..... E04G 11/02; B28B 7/22

(52) U.S. Cl. ..... 249/27; 249/13; 249/180; 52/79.11; 52/745.13; 264/31

(58) Field of Search ..... 249/13, 18, 27, 249/33, 161, 180, 152, 184; 52/79.1, 79.11, 79.9, 262, 270, 745.11–13, 741.13; 425/62, 88; 264/31, 35, 73, 333, 334, 336

(56) References Cited

U.S. PATENT DOCUMENTS

| | | | | | |
|---|---|---|---|---|---|
| 2,618,039 | A | | 11/1952 | Hyre | 25/131 |
| 3,215,389 | A | | 11/1965 | Williams | 248/327 |
| 3,372,519 | A | * | 3/1968 | Russell | 52/274 |
| 3,559,944 | A | | 2/1971 | Clough | 249/36 |
| 3,600,870 | A | * | 8/1971 | Greeahalgh | 52/745.11 |
| 3,706,168 | A | * | 12/1972 | Pilish | 52/234 |
| 3,724,143 | A | * | 4/1973 | Paukulis | 52/79.2 |
| 3,730,475 | A | * | 5/1973 | Werfel et al. | 249/13 |
| 3,750,366 | A | | 8/1973 | Rich, Jr. et al. | 52/79 |
| 3,772,835 | A | * | 11/1973 | Cox et al. | 52/79.1 |
| 3,814,374 | A | * | 6/1974 | Beemer et al. | 249/180 X |
| 3,847,521 | A | * | 11/1974 | Stickler, Jr. | 425/62 |
| 3,898,776 | A | * | 8/1975 | Cox et al. | 52/79.1 |
| 3,990,193 | A | | 11/1976 | Ray et al. | 52/79 |
| 4,038,798 | A | | 8/1977 | Sachs | 52/309 |
| 4,050,213 | A | | 9/1977 | Dillon | 52/743 |
| 4,068,430 | A | | 1/1978 | van der Lely | 52/79.7 |
| 4,127,971 | A | * | 12/1978 | Rojo, Jr. | 52/79.11 |
| 4,185,423 | A | | 1/1980 | Gutierrez | 52/79.9 |
| 4,211,043 | A | | 7/1980 | Coday | 52/79.1 |
| 4,240,236 | A | | 12/1980 | Molenaar | 52/741 |
| 4,244,682 | A | * | 1/1981 | Willingham | 425/62 |
| 4,252,292 | A | * | 2/1981 | Armas | 249/27 |
| 4,650,150 | A | * | 3/1987 | Pacheco-Pifano | 249/180 X |
| 4,886,234 | A | | 12/1989 | Schwörer et al. | 249/196 |
| 5,524,861 | A | * | 6/1996 | Solomon | 249/27 |
| 5,643,488 | A | * | 7/1997 | Lee | 249/34 |
| 5,893,241 | A | * | 4/1999 | Schroeder | 52/79.1 |
| 6,058,672 | A | | 5/2000 | McClellan | 52/587.1 |

FOREIGN PATENT DOCUMENTS

| | | | |
|---|---|---|---|
| WO | 8403658 | * | 9/1984 |

* cited by examiner

*Primary Examiner*—Jong-Suk (James) Lee
(74) *Attorney, Agent, or Firm*—Allen, Dyer, Doppelt, Milbrath & Gilchrist, P.A.

(57) ABSTRACT

A method for making a poured-in-place concrete building having a plurality of rooms includes assembling an outer form around a periphery of a floor and positioning a plurality of unitary room forms within the periphery of the floor. Each unitary room form may include a plurality of rigid panels connected together along respective adjacent sides thereof defining a closed shape with an open bottom and an open top and having a draft thereto to facilitate removal as a unit. The method may also include pouring concrete between the outer form and adjacent unitary room forms and between adjacent unitary room forms to provide outer concrete walls and interior concrete walls, respectively, to define the rooms. Further, each of the unitary room forms may be removed as a unit from adjacent concrete walls, the outer form may be disassembled, and a roof may be provided over the rooms.

20 Claims, 7 Drawing Sheets

METHOD AND APPARATUS FOR MAKING CONCRETE BUILDINGS

RELATED APPLICATION

The present application is a continuation of U.S. application Ser. No. 09/354,433 filed Sep. 20, 1999, abandoned.

FIELD OF THE INVENTION

The present invention relates to the field of construction, and, more particularly, to concrete buildings having a plurality of rooms and related methods of manufacture.

BACKGROUND OF THE INVENTION

Many buildings are constructed with concrete walls for stability and durability. These properties may be especially desirable for buildings, such as houses, located in areas that are prone to destructive storms or earthquakes, for example. Further, concrete walls are not susceptible to damage from termites or rotting, as wood and other building materials may be.

One well known prior art method for making concrete walls is to use cinder blocks held together with mortar. Because concrete is quite heavy, cinder blocks provide an effective way to distribute this weight over several individually manageable pieces that may be more easily erected in place. Yet, it generally requires numerous laborers and a significant amount of time to assemble an entire building with cinder blocks. Further, skilled masons are typically needed.

Another prior art method for making concrete walls is to pour the walls in place using forms. The forms may be assembled on a foundation or floor, for example, and concrete is then poured into the form and allowed to set. One example of a form for casting concrete walls is disclosed in U.S. Pat. No. 3,559,944 to Clough entitled "Means for Constructing a Hollowed Wall Concrete Structure." The form is collapsible and may be used to construct a hollow wall structure with inner support columns that are insulated from adjacent parallel outer walls to prevent temperature transfer therebetween. Another similar form for making concrete walls is disclosed in U.S. Pat. No. 2,618,039 to Hyre entitled "Form for Casting Concrete Walls." This form may be used for casting walls having cavities therein in which pipes or cables may be inserted, for example.

While it is relatively easy to pour large outer walls of a building in place using forms, it may be more difficult to do so in the interior of the building using the collapsible forms of the prior art. This is because there may be limited room available to assemble and disassemble the forms. Also, the assembly time for numerous interior wall forms may be substantial. Thus, houses or other buildings that have "poured-in-place" outer walls typically have interior walls that are constructed with studs (e.g., metal or wood) or cinder blocks, for example. As with cinder block walls, stud walls may similarly require carpenters or other skilled laborers to build, which may lead to increased costs and construction time.

SUMMARY OF THE INVENTION

In view of the foregoing background, it is therefore an object of the invention to provide a method and related system for making a poured-in-place building that may be constructed relatively quickly and with a reduced need for skilled laborers.

This and other objects, features, and advantages in accordance with the present invention are provided by a method for making a poured-in-place concrete building including a plurality of rooms. The method may include positioning a plurality of unitary room forms within a periphery of a floor and assembling an outer form around the periphery of the floor. Each unitary room form may include a plurality of rigid panels fixedly connected together as an integral unit along respective adjacent sides thereof defining a closed shape with an open bottom and an open top. Further, the rigid panels may have a draft thereto to facilitate removal of each of the unitary room forms as the integral unit. For example, the draft of each rigid panel may be about one-half inch over a height thereof. The method may also include pouring concrete between the outer form and adjacent unitary room forms and between adjacent unitary room forms to provide outer concrete walls and interior concrete walls, respectively, which define the rooms. Each of the unitary room forms may be removed as the integral unit from adjacent concrete walls. Further, the outer form may be disassembled and a roof may be provided over the rooms.

More specifically, providing the roof may include positioning a plurality of precast concrete panels adjacent upper ends of the outer and interior concrete walls. A concrete layer may be poured over the precast concrete panels.

Each unitary room form may include four generally rectangular rigid panels. Also, each of the rigid panels may include steel, and adjacent steel panels may be welded together prior to use. Removing each of the unitary room forms may include lifting each of the unitary room forms from the outer and interior concrete walls.

Assembling the outer form may include removably assembling a plurality of rigid panels together to define four generally rectangular form portions. Openings may be framed for interior concrete walls prior to assembling the outer form, and reinforcing members may be positioned prior to pouring the concrete.

The invention also relates to a form system for making a poured-in-place concrete building including a plurality of rooms. The system may include a plurality of rigid panels to be assembled together to define an outer form positioned around a periphery of a floor. Each rigid panel may have opposing sides to be removably connected to adjacent panels. Further, the system may include a plurality of unitary room forms to be positioned within the periphery of the floor. Each unitary room form may include a plurality of rigid panels fixedly connected together as an integral unit along respective adjacent sides thereof defining a closed shape having an open bottom and an open top, the rigid panels of each unitary room form having a draft thereto to facilitate removal of each of the unitary room forms as an integral unit after pouring of concrete.

More specifically, each unitary room form may include four generally rectangular rigid panels. Each of the rigid panels may include steel, and adjacent steel panels may be welded together. Further, the draft of each of the rigid panels may be about one-half inch over a height thereof.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
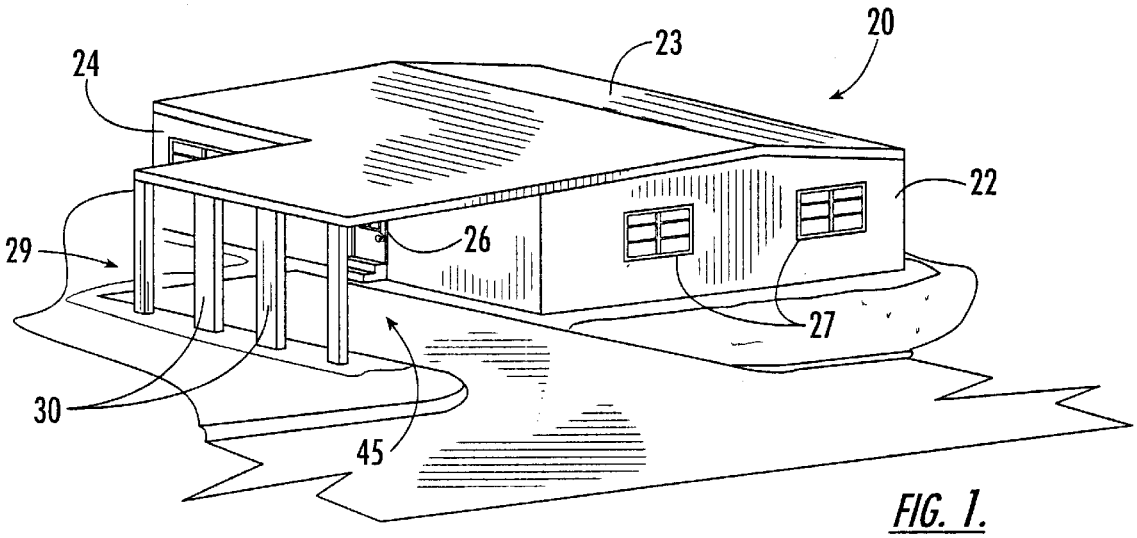
FIG. 1 is perspective view of a building according to the present invention.
Figure 2:
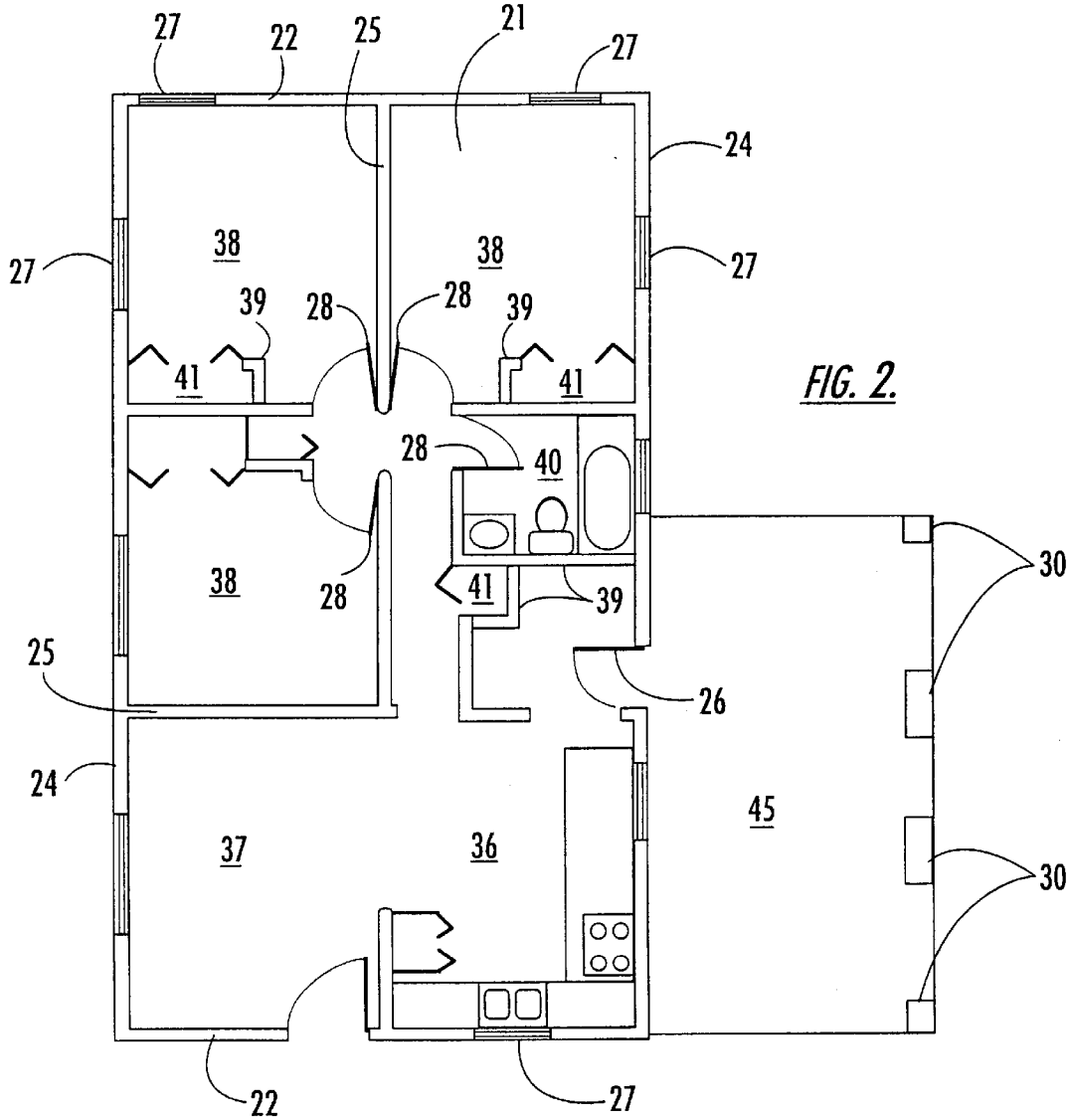
FIG. 2 is a top plan view of the building of FIG. 1 with the roof removed to show the interior rooms.
Figure 3:
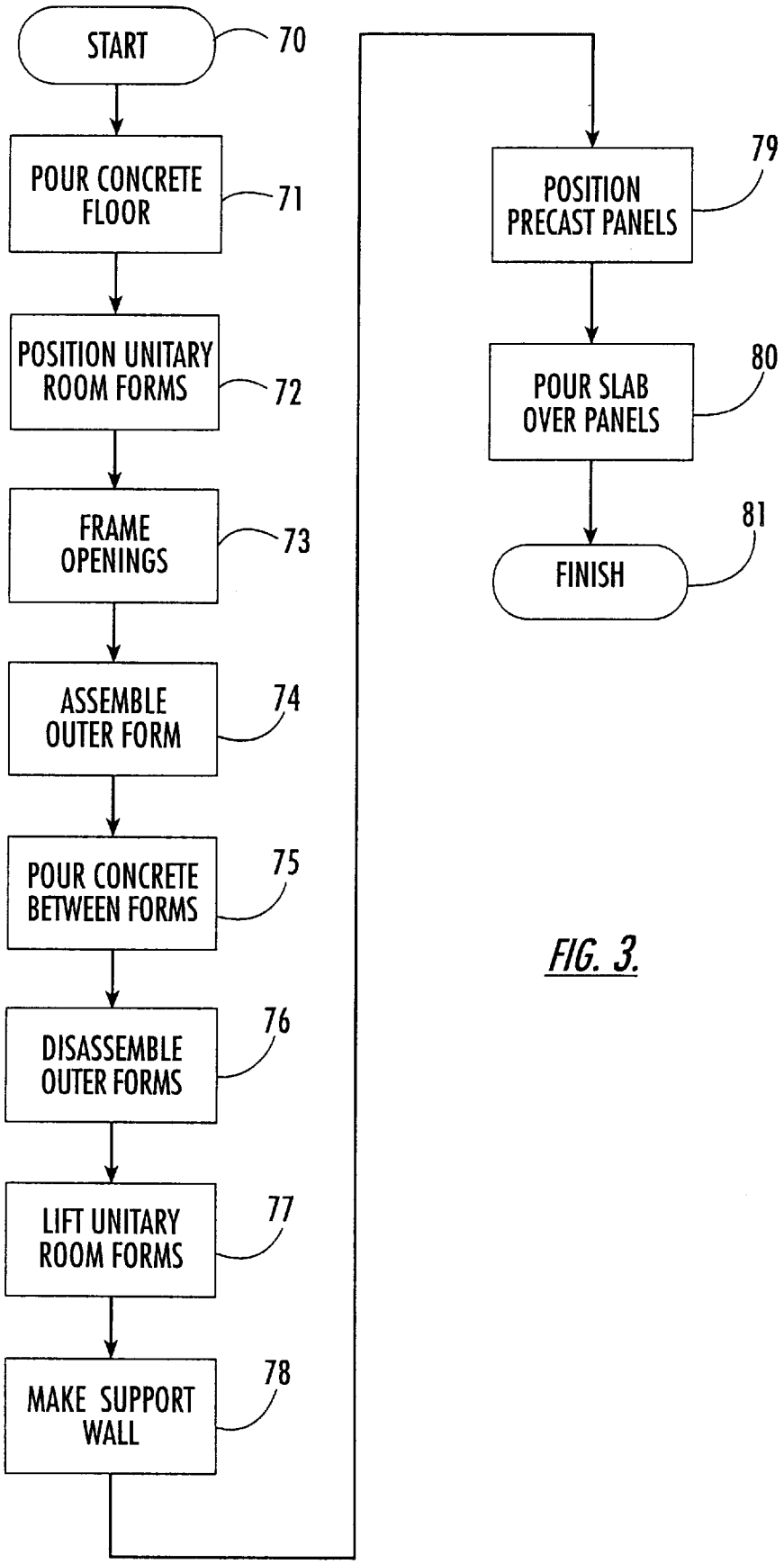
FIG. 3 is a flow chart of a method for making the building of FIG. 1.

Referring to FIGS. 1 and 2, a poured-in-place concrete building 20 having a plurality of rooms (e.g., a house) is now generally described. A floor 21 may be a poured-in-place concrete slab, for example. Of course, other suitable floors known to those of skill in the art may also be used. The floor 21 may include reinforcing members, such as rebar, as well as pipes, wiring, etc. for the building 20, as will be appreciated by those of skill in the art.

A plurality of poured-in-place outer concrete walls 22, 24 are positioned around a periphery of the floor 21. Additionally, a plurality of poured-in-place interior concrete walls 25 are positioned within the outer concrete walls 22, 24 which define the rooms. A roof 23 may be positioned adjacent upper ends of the outer walls 22, 24 and the inner concrete walls 25 and covering the rooms.

Further structural features of the building 20 will be more readily understood with reference to a method for making the building, which is illustrated in FIGS. 3–10. Construction of the building 20 begins (Block 70) by pouring the concrete floor 21, at Block 71. A plurality of unitary room forms 52 are positioned within a periphery of the concrete floor 21, at Block 72. The unitary room forms 52 are preferably positioned before assembling an outer form 49 (discussed further below), although the outer form may be assembled prior to positioning the unitary room forms, if desired.

Figure 4:
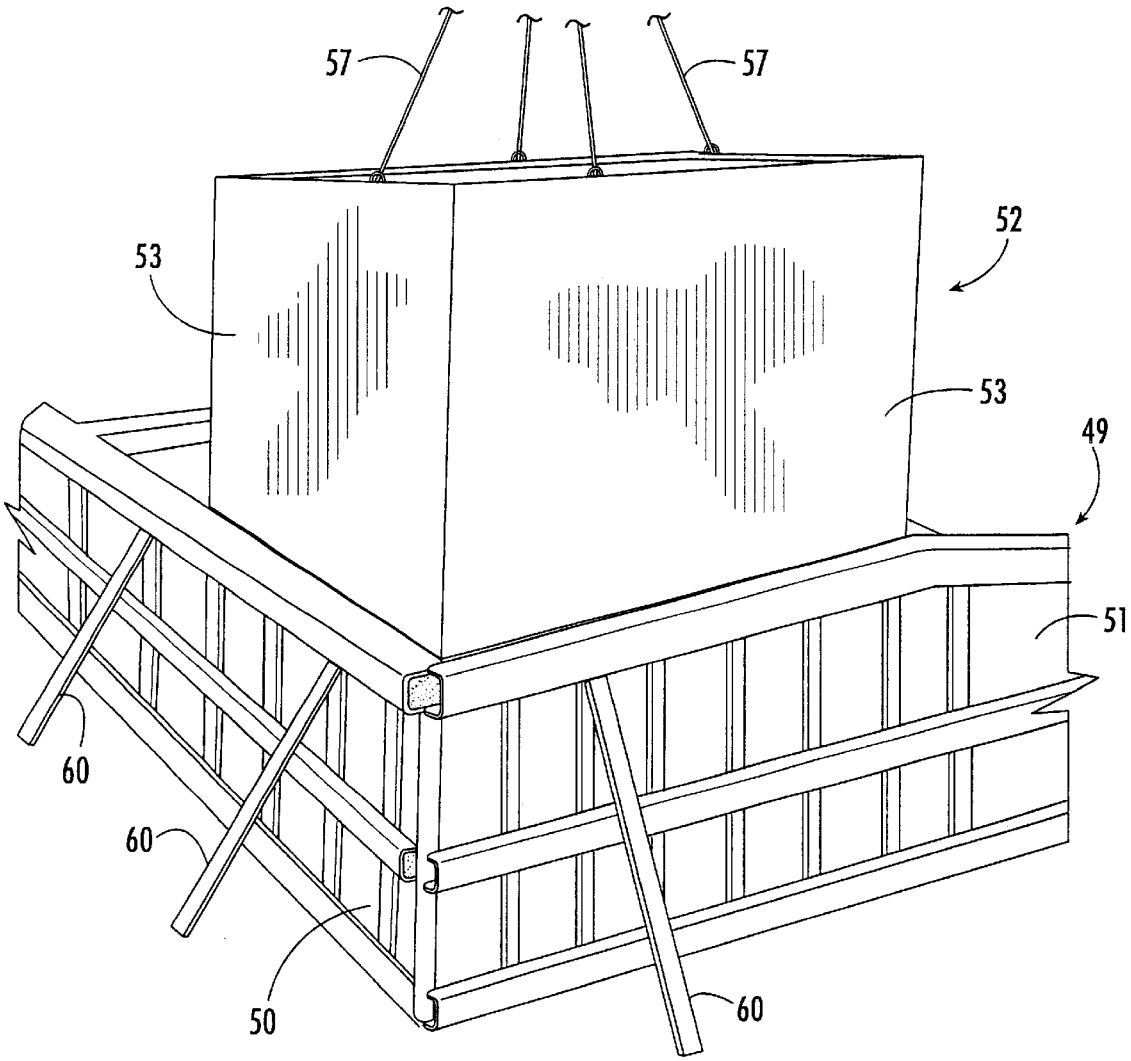
FIG. 4 is a perspective view illustrating a unitary room and an outer form in accordance with the invention.

A unitary room form 52 and the outer form 49 are illustratively shown in FIG. 4. The unitary room forms 52 may be connected to a crane (not shown), for example, using cables 57 for lifting during positioning and removal. The building 20 illustrated in FIGS. 1 and 2 is made using a generally rectangular outer form 49 and six unitary room forms 52, each of which is also generally rectangular and substantially the same size.

Each unitary room form 52 may include a plurality of rigid panels 53 fixedly connected together as an integral unit along respective adjacent sides thereof. For example, each of the rigid panels 53 may be steel, and adjacent steel panels may be welded together prior to use. Once connected, the rigid panels 53 define a closed shape, such as a rectangle, with an open bottom and an open top. The unitary room forms may include lower and upper rails 54, 55 for alignment and stabilization of the forms (see FIG. 7). Wales 56 and bolts 57 may be used to maintain the accurate relative position of the unitary room forms 52 during pouring, as will be appreciated by those of skill in the art. Supports 60 may be similarly used to stabilize the outer form 49 (FIG. 4).

Furthermore, openings may be framed (Block 73) for the interior concrete walls 25 prior to assembling the outer form 49. The openings may be used to define passageways between adjacent rooms so that interior doors 28 may be mounted therein, for example. Plumbing, wiring, etc. may also be run when the openings are framed, as will be appreciated by those of skill in the art.

As noted above, the outer form 49 is assembled around a periphery of the floor 21, at Block 74. The outer form 49 may include a plurality of rigid panels 50, 51 (e.g., steel) assembled to define four generally rectangular form portions. Upper ends of the panels 51 may have a pitch so that the outer walls 22, and thus the roof 23, will have a corresponding pitch. The panels 50, 51 may carry opening frames thereon which are used to define passageways therethrough for an exterior door 26, windows 27, etc. in the outer end walls 22 and outer side walls 24 of the building 20 when the outer walls are poured.

Figure 5:
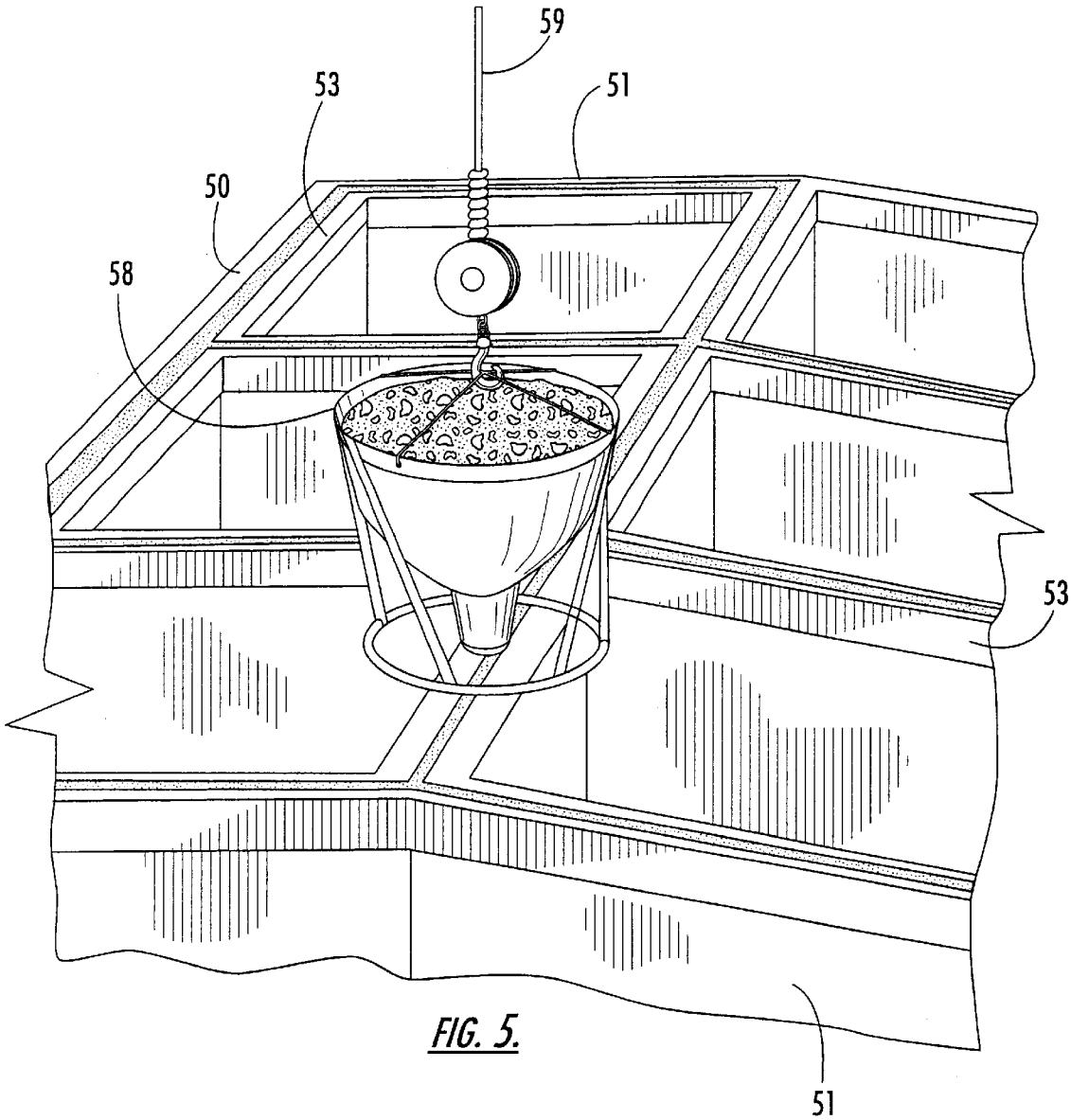
FIG. 5 is a perspective view illustrating pouring concrete between the unitary room forms and outer form in accordance with the invention.
Figure 6:
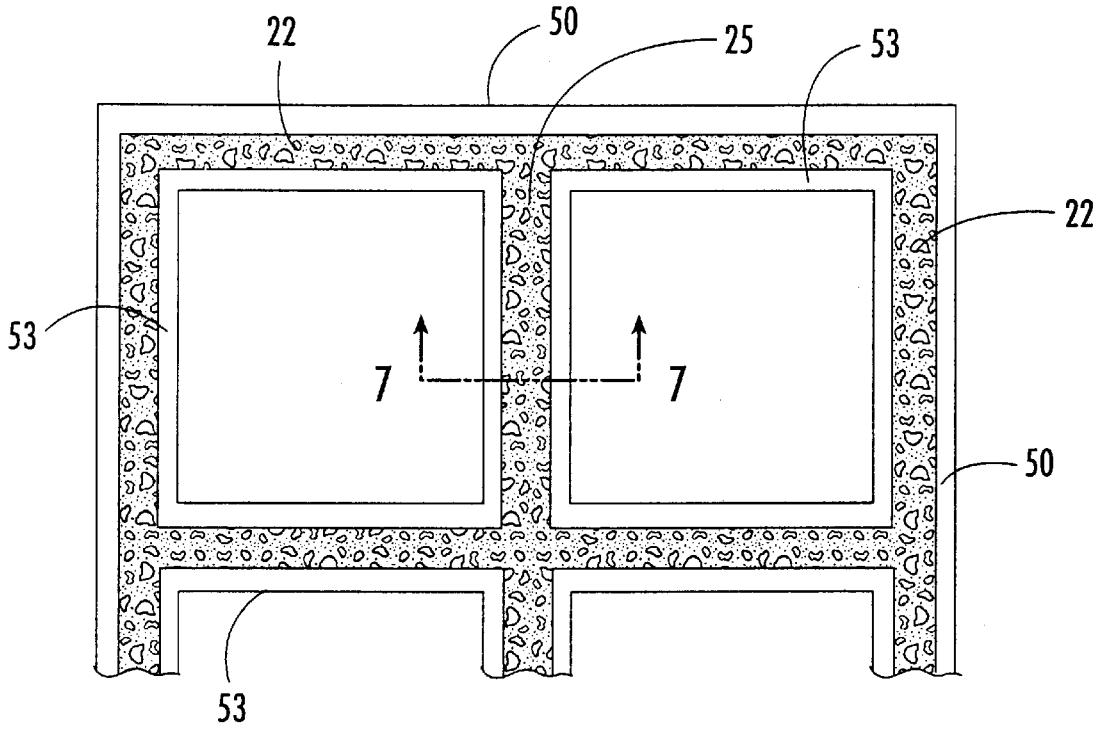
FIG. 6 is a top plan view of the unitary room forms and outer form after concrete has been poured therebetween in accordance with the invention.
Figure 7:
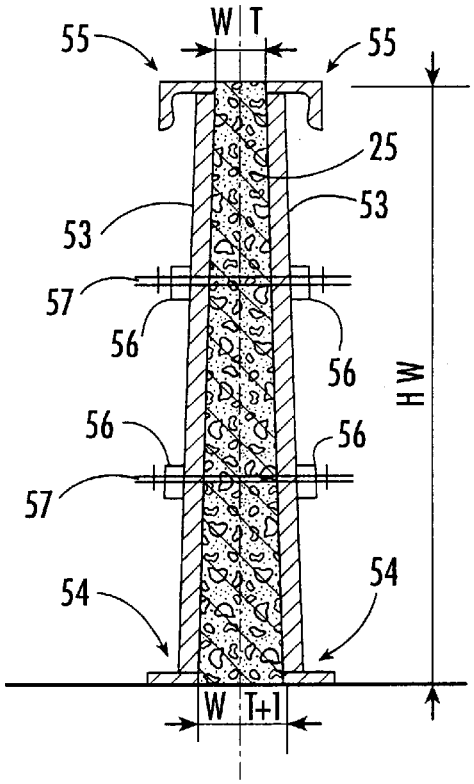
FIG. 7 is a cross-sectional view taken along line 7—7 of FIG. 6.

To provide the outer walls 22, 24 and interior walls 25 which define the rooms of the building 20, concrete is poured between the outer form 49 and the unitary room forms 52 and between adjacent unitary room forms (Block 75), as may be seen in FIGS. 5–7. The concrete may be poured using a concrete pump or a concrete container 58 attached to a crane (not shown) with a cable 59, as seen in FIG. 5.

When concrete is poured between the outer and unitary room forms 49, 52, a relatively large hydrostatic pressure results from the weight of the concrete. For example, for an eight feet high wall, a pressure at the lower end of the wall (i.e., near the floor 21) may be about 1200 lbs/ft$^2$. This pressure would ordinarily make removal of the unitary room forms 52 extremely difficult, if not impossible, without destroying some or all of the outer walls 22, 24 and interior concrete walls 25.

According to the invention, the rigid panels 53 of each unitary room form 52 preferably have a draft thereto to facilitate removal as the integral unit with little or no damage to the poured-in-place outer walls 22, 24 and interior concrete walls 25. For example, the draft of each rigid panel 53 of the unitary room form 52 may be about one-half inch over a height HW thereof from a lower end 54 to an upper end 55 thereof, for example (see FIG. 7). As a result, the poured-in-place outer walls 22, 24 and interior walls 25 will have a progressively decreasing thickness from their lower ends to their upper ends. That is, the lower end of each interior concrete wall 25 will extend outwardly in relation to the upper end thereof by about one-half inch. Similarly, respective lower ends of each outer concrete wall 22, 24 will also extend outwardly in relation to upper ends thereof by about one-half inch. Of course, greater or lesser drafts may be used for the rigid panels 53, but a one-half inch draft has been found to provide a good balance between ease of removal and not making the walls too far out of plumb.

Once the concrete has been allowed to set for a predetermined period, the outer form 49 may be disassembled and removed and the unitary room forms 52 lifted out, as shown in FIG. 4. It will be appreciated by those of skill in the art that the amount of time that the walls are allowed to set before removal of the unitary room forms 52 will vary depending upon the type of concrete used (e.g., quick drying, etc.).

Generally speaking, it is desirable to remove the unitary room forms 52 before the concrete therebetween has completely set. This reduces the likelihood that the unitary room forms 52 will seize to the concrete. By way of example, for a typical quick drying concrete the unitary room forms 52 may be removed after about two hours. Of course, the outer walls 22, 24 and interior concrete walls 25 should be sufficiently set before removal of the unitary form 52. Also, the outer form 49 and unitary room forms 52 should be cleaned after use to reduce a likelihood of seizing during subsequent uses. The outer form 49 may be removed after the concrete is completely set, for example.

The unitary room forms 52 may be lifted out by a crane as noted above. Removing the outer form 49 may include disconnecting adjacent panels 50, 51 and allowing the disconnected panels to pivot outwardly and away from the outer end and side concrete walls 24, 22, respectively. The opening frames carried by the outer form 52 (discussed above) are preferably angled to facilitate the outward rotation.

The surfaces of the interior concrete walls 25 and interior surfaces of the outer walls 22, 24 require little, if any, finishing upon removal of the forms. It will be appreciated that this provides a significant time savings over using stud walls, for example, which not only require skilled laborers to frame, but also to hang drywall upon, for example. Even so, a thin coating of concrete or stucco may be used, for example, to provide additional texture to the interior walls and interior surfaces of the outer walls 22, 24, if desired.

A support wall 29 may be spaced outwardly from an outer wall 24 portion, for example. The support wall 29 may be a solid wall or a plurality of spaced columns 30, as shown in FIGS. 1 and 2. The support wall 29 is used to support a portion of the roof 23 which extends outwardly past the outer wall 24 to an upper surface of the support wall to define a covered area 45, such as a carport, for example.

The roof 23 may be provided by positioning a plurality of precast concrete panels 31 adjacent upper ends of the outer walls 22, 24 and interior concrete walls 25, at Block 79. The precast concrete panels 31 are preferably arranged in an array adjacent upper ends of the outer walls 22, 24 and interior concrete walls 25 and have a space 46 therebetween (e.g., three inches). The precast panels 31 may cover the tops of the rooms thereunder and the covered area 45 to provide a ceiling for the rooms and a base for a poured-in-place concrete layer 36 (described further below), which together form the roof 23. In the building 20 illustrated in FIGS. 1 and 2, a total of eight precast concrete panels 31 are used (one for each of the six rooms and two for the covered area 45).

Figure 8:
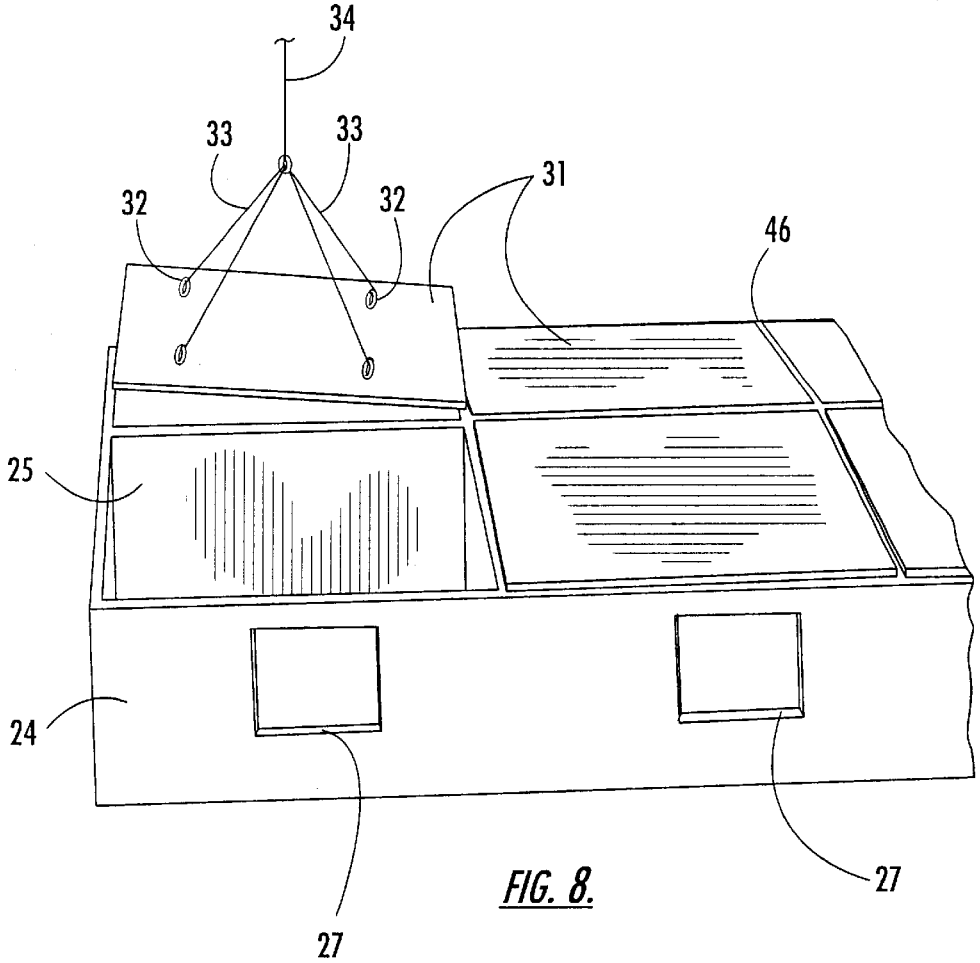
FIG. 8 is a perspective view showing positioning precast panels for the roof in accordance with the invention.

The precast concrete panels 31 preferably include reinforcing members, such as rebar, for rigidity and strength. For example, the precast concrete panels 31 may include a grid of rebar spaced at three inch intervals, though other configurations are also possible according to the invention. Hooks 32 may be recessed within the precast concrete panels 31 so that the panels may be attached by cables 33, 34 to a crane to facilitate positioning, as shown in FIG. 8.

Figure 9:
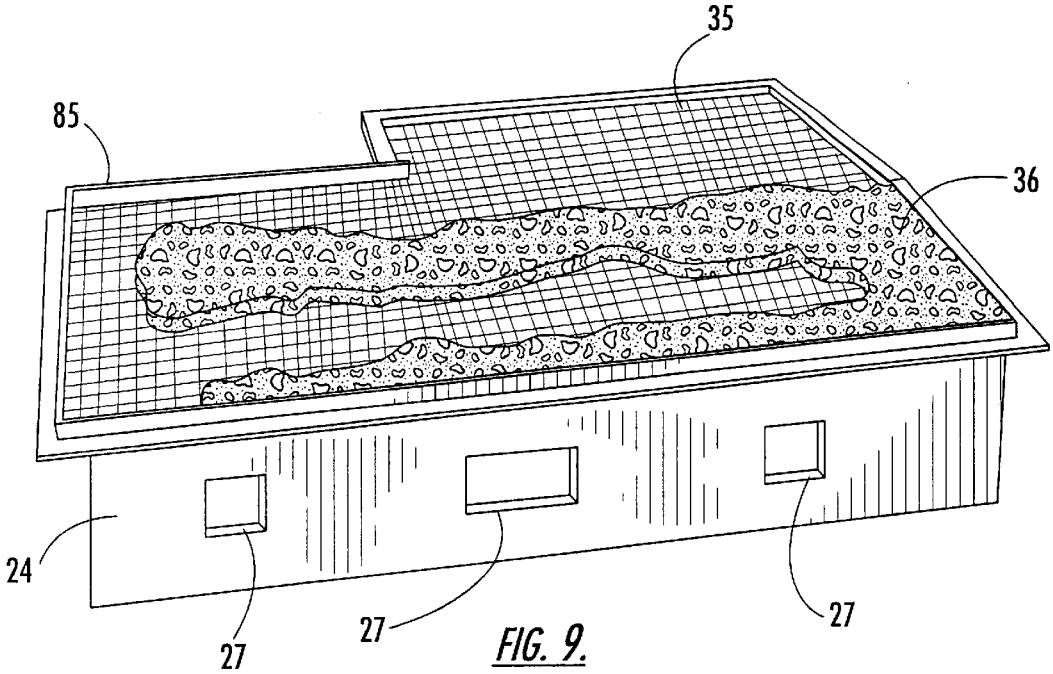
FIG. 9 is a perspective view showing pouring a concrete slab over the precast panels in accordance with the invention.
Figure 10:
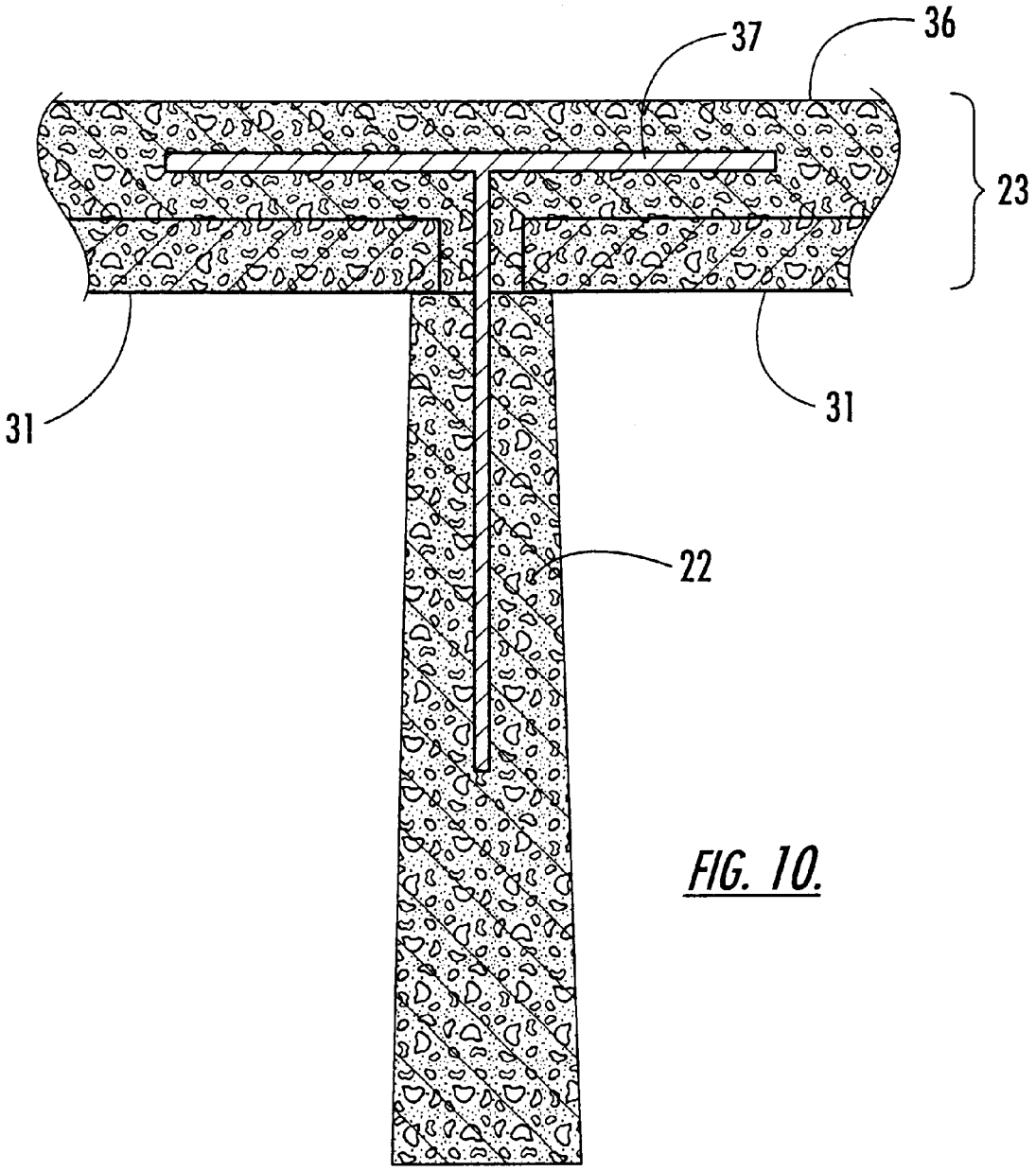
FIG. 10 is a cross-sectional view of an interior wall and roof of the building of FIG. 1.

The hooks 32 may also be used for securing reinforcing members, such as wire mesh 35 or rebar, for example, to the tops of the precast concrete panels 31. The wire mesh 35 provides reinforcement for the concrete layer 36 which is poured in place over the precast concrete panels 31 (Block 80) and fills the spaces 46 therebetween, as shown in FIG. 9. The concrete layer 36 may be poured using a concrete pump or concrete container as discussed above with reference to FIG. 5.

In addition, a plurality of reinforcing members 37 (e.g., rebar) may be positioned within the interior concrete walls 25 which extend from within the interior concrete walls through the spaces 46 between the precast concrete panels 31. The reinforcing members 37 provide additional support and rigidity between the interior concrete walls 25 and the roof 23, as will be appreciated by those of skill in the art.

As noted above, the roof 23 is preferably pitched to facilitate water run off. Again, the outer form 49 and the unitary room forms 52 have upper portions defining a pitch for the pitched roof 23. Furthermore, the roof 23 may extend past the outer walls 22, 24 to provide an overhang around the building 20. For example, a frame 85 (e.g., steel) may be used to define the overhang, which may be about eighteen inches, for example, though other lengths may also be used. The frame may also provide a support for pouring the concrete layer 36.

The rooms of the building 20 may include a kitchen 36, a living area 37, and bedrooms 38, for example (FIG. 2). Furthermore, additional interior walls 39 may be erected to define a bathroom 40 and closets 41, for example. The additional interior walls 39 may be cinder block walls and/or stud walls, such as metal stud walls, for example.

It will also be appreciated that because substantially all of the interior walls of the building 20 are the poured-in-place interior walls 25, substantial savings of skilled laborers (e.g., masons, carpenters, etc.) may be realized. In fact, a substantial portion of the construction of the building 20 may be performed according to the invention by relatively unskilled laborers using only wrenches, wire ties, and pry bars, for example. This savings results in a quicker construction time and reduced building costs, which translates to lower prices that a consumer will have to pay for the building 20. As a result, the buildings and methods of the present invention may be particularly well suited for government subsidized or low income housing, though numerous other uses are also possible. Additionally, the building 20 of the present invention is very strong as a result of the poured-in-place outer walls 22, 24 and interior walls 25, making the buildings less susceptible to damage from severe storms, earthquakes, etc.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that other modifications and embodiments are intended to be included within the scope of the appended claims.

That which is claimed is:

1. A method for making a poured in-place concrete building comprising a plurality of rooms, the method comprising:

positioning a plurality of unitary room forms within a periphery of a floor, each of the unitary room forms comprising a plurality of rigid panels fixedly connected together as an integral unit along respective adjacent sides thereof defining a closed shape with an open bottom and an open top, the rigid panels having a draft thereto to facilitate removal of each of the unitary room forms as the integral unit;

assembling an outer form around the periphery of the floor;

pouring concrete between the outer form and adjacent unitary room forms and between the adjacent unitary room forms to provide outer concrete walls and interior concrete walls, respectively, to define the rooms;

removing each of the unitary room forms as the integral unit from adjacent concrete walls;

disassembling the outer form; and providing a roof over the rooms.

2. The method of claim 1 wherein providing the roof comprises positioning a plurality of precast concrete panels adjacent upper ends of the outer and interior concrete walls.

3. The method of claim 2 wherein providing the roof further comprises pouring a concrete slab over the precast concrete panels.

4. The method of claim 1 wherein each unitary room form comprises four generally rectangular rigid panels.

5. The method of claim 4 wherein each of the rigid panels comprises steel; and wherein adjacent steel panels are welded together prior to use.

6. The method of claim 1 wherein removing each of the unitary room forms comprises lifting each of the unitary room forms from the outer and interior concrete walls.

7. The method of claim 1 further comprising framing openings for the interior concrete walls prior to assembling the outer form.

8. The method of claim 1 wherein assembling the outer form comprises removably assembling a plurality of rigid panels together to define four generally rectangular form portions.

9. The method of claim 1 wherein the draft of each of the rigid panels is about one-half inch over a height thereof.

10. The method of claim 1 further comprising positioning reinforcing members prior to pouring the concrete.

11. A method for making a poured-in-place concrete building comprising a plurality of rooms, the method comprising:

constructing a plurality of unitary room forms, each constructed by welding a plurality of rigid metal panels together along respective adjacent sides thereof defining a closed shape with an open bottom and an open top and having a draft thereto to facilitate removal as a unit;

positioning the unitary room forms within a periphery of a floor;

assembling an outer form around a periphery of the floor;

pouring concrete between the outer form and adjacent unitary room forms and between adjacent unitary room forms to provide outer concrete walls and interior concrete walls, respectively, to define the rooms;

removing the unitary room forms by lifting each as a unit from adjacent concrete walls; and providing a roof over the rooms.

12. The method of claim 11 wherein providing the roof comprises positioning a plurality of precast concrete panels adjacent upper ends of the outer and interior concrete walls.

13. The method of claim 12 wherein providing the roof further comprises pouring a concrete slab over the precast concrete panels.

14. The method of claim 11 further comprising framing openings for the interior concrete walls prior to assembling the outer form.

15. The method of claim 11 wherein the draft of each of the unitary room forms is about one-half inch over a height thereof.

16. The method of claim 11 further comprising positioning reinforcing members prior to pouring the concrete.

17. A form system for making a poured-in-place concrete building comprising a plurality of rooms, the system comprising:

a plurality of rigid panels to be assembled together to define an outer form positioned around a periphery of a floor, each rigid panel having opposing sides to be removably connected to adjacent panels; and a plurality of unitary room forms to be positioned within the periphery of the floor, each unitary room form comprising a plurality of rigid panels fixedly connected together as an integral unit along respective adjacent sides thereof defining a closed shape having an open bottom and an open top, said rigid panels of each unitary room form having a draft thereto to facilitate removal of each of said unitary room forms as the integral unit after pouring of concrete.

18. The form system of claim 17 wherein each of the unitary room forms comprises four generally rectangular rigid panels.

19. The form system of claim 17 wherein each of the rigid panels of the unitary room forms comprises steel; and wherein adjacent steel panels are welded together.

20. The form system of claim 17 wherein the draft of each of said rigid panels of said unitary room forms is about one-half inch over a height thereof.

* * * * *